US006626312B2

(12) United States Patent
Maturana

(10) Patent No.: US 6,626,312 B2
(45) Date of Patent: Sep. 30, 2003

(54) STORAGE BAG

(76) Inventor: Javier Urzua Maturana, Avda. Jorge Alessandri Rodriguez 10.700, Santiago (CL)

( * ) Notice: Subject to any disclaimer, the term of this patent is extended or adjusted under 35 U.S.C. 154(b) by 0 days.

(21) Appl. No.: 09/991,182

(22) Filed: Nov. 14, 2001

(65) Prior Publication Data

US 2002/0030055 A1 Mar. 14, 2002

Related U.S. Application Data

(63) Continuation-in-part of application No. 09/887,210, filed on Jun. 22, 2001.

(30) Foreign Application Priority Data

Jun. 28, 2000 (CL) ..... 1689-2000

(51) Int. Cl.[7] ..... B65D 30/08; B65D 25/16

(52) U.S. Cl. ..... 220/1.6; 220/495.01; 220/495.06; 383/109; 383/113; 428/35.3

(58) Field of Search ..... 220/1.6, 495.01, 220/495.06; 383/113, 116, 80, 96, 109; 428/35.3, 35.2

(56) References Cited

U.S. PATENT DOCUMENTS

| | | | | | |
|---|---|---|---|---|---|
| 2,435,743 | A | * | 2/1948 | Geimer | 383/101 |
| 2,612,924 | A | * | 10/1952 | Cunningham | 383/3 |
| 2,687,158 | A | * | 8/1954 | Owen | 206/521 |
| 3,173,579 | A | * | 3/1965 | Curie et al. | 222/105 |
| 3,578,213 | A | | 5/1971 | Clark et al. | |
| 3,750,730 | A | * | 8/1973 | Dorsch | 383/96 |
| 3,939,972 | A | * | 2/1976 | Mayworm | 206/219 |
| 4,056,138 | A | | 11/1977 | Fagniart | |
| 4,101,711 | A | * | 7/1978 | Stillman | 428/35.2 |
| 4,232,803 | A | | 11/1980 | Muller et al. | |
| 4,378,069 | A | * | 3/1983 | Franco | 383/207 |
| 4,387,126 | A | * | 6/1983 | Rebholz | 428/34.3 |
| 4,445,550 | A | * | 5/1984 | Davis et al. | 141/329 |

(List continued on next page.)

FOREIGN PATENT DOCUMENTS

| | | |
|---|---|---|
| GB | 1439019 | 6/1976 |
| GB | 2113180 | 8/1983 |
| GB | 2160498 | 12/1985 |
| GB | 2354754 | 4/2001 |
| WO | WO 97/01498 | 1/1997 |
| WO | WO 00/66461 | 11/2000 |
| WO | 10/70598 | * 9/2001 |

OTHER PUBLICATIONS

Print out from Trans Ocean Distribution web page (www-.todbulk.com) regarding Rhinobulk and Multibulk Systems, dated Jul. 26, 2001.

*Primary Examiner*—Nathan J. Newhouse
*Assistant Examiner*—Joseph C. Merek

(57) ABSTRACT

A storage bag for storage and transport of a material includes an internal layer, an external layer, and an intermediate layer. The internal layer defines an interior space for storing the material and is resistant to interaction with the material. The external layer is perforation resistant. The intermediate layer is positioned between the internal layer and the external layer. Each of the layers is configured as a bag with an opening. An inlet for loading and discharge of the material into and from the interior space is provided and the internal, intermediate, and external layer openings are coupled to the inlet to allow the entrance of material into the interior space. The internal layer includes four sheets of triple layer co-extruded polyethylene. The intermediate layer is a non-woven geotextile and the external layer is a non-woven geotextile of high density polyethylene. A metallized layer may also be positioned between the intermediate and internal layers for deterring the entrance of light into the internal layer. The intermediate layer bag is smaller dimensionally than the internal layer bag.

4 Claims, 7 Drawing Sheets

U.S. PATENT DOCUMENTS 4,468,812 A 8/1984 Grosvenor
4,573,508 A 3/1986 Knaus
4,606,970 A * 8/1986 Sharps, Jr. ..... 442/398
4,643,475 A 2/1987 Neumann
4,784,287 A 11/1988 Yamada et al.
4,807,299 A 2/1989 Nattrass et al.
4,875,596 A * 10/1989 Lohse ..... 220/1.6
4,880,342 A 11/1989 Pradovic
5,025,925 A 6/1991 Wiklund
5,076,710 A 12/1991 Derby
5,082,244 A * 1/1992 Krier et al. ..... 251/149.6
5,115,943 A 5/1992 Coleman
5,188,460 A 2/1993 Dorse
5,228,271 A * 7/1993 Wallace ..... 53/434
5,344,048 A 9/1994 Bonerb
5,452,849 A * 9/1995 Schramer et al. ..... 229/206
5,499,743 A * 3/1996 Blumenkron ..... 222/107
5,512,355 A 4/1996 Fuson
5,524,781 A 6/1996 Podd et al.
5,560,974 A * 10/1996 Langley ..... 428/198
5,659,933 A * 8/1997 McWilliams ..... 27/28
5,746,343 A 5/1998 Waltke et al.
5,824,995 A 10/1998 Wise
5,975,642 A 11/1999 Dibble et al.
6,015,057 A 1/2000 Stone et al.
6,113,270 A 9/2000 Hafer
6,268,029 B1 * 7/2001 Akao ..... 428/35.2
6,403,176 B1 * 6/2002 Patouraux et al. ..... 428/35.2

* cited by examiner

STORAGE BAG

CROSS-REFERENCE TO RELATED APPLICATIONS

This application is a continuation-in-part of copending U.S. patent application Ser. No. 09/887,210, filed Jun. 22, 2001.

FIELD OF THE INVENTION

The claimed invention relates to a storage device. In particular, the invention relates to a bag for use in storage and bulk transport of liquids by commercial transport vehicles.

BACKGROUND

Metallic tanks have previously been used to transport substantial quantities of liquid in bulk. These tanks are handled similarly to traditional containers and mounted over trucks, vessels and other air, maritime and land vehicles. Other materials have also been used in the manufacture of storage tanks, such as reinforced plastic or composites.

Non-rigid, collapsible bags have also been utilized for the storage and transport of liquids. The bags are reusable and cleanable through one end which is open, but sealed with multiple clamps. One such bag is the Multibulk, manufactured by Trans-Ocean Distribution. This bag is a double bag that is partially disposable. The external bag is reusable and the internal bag is disposable.

SUMMARY

The claimed invention is a storage bag for carrying a storage material. The storage bag includes an internal layer, an external layer, an intermediate layer, and an inlet. The internal layer is configured as a bag to define an interior space for storing the storage material. The internal layer bag has an opening for entrance of the storage material into the interior space. The external layer is perforation resistant, configured as a bag with an opening, and positioned around the internal layer bag. The intermediate layer is configured as a bag with an opening and is positioned between the internal layer and the external layer. The inlet is for loading and discharge of the storage material into and from the interior space. The internal, intermediate, and external layer bag openings are coupled to the inlet.

The storage bag may also include a metallized layer configured as a bag with an opening and positioned between the internal layer and the intermediate layer. The metallized layer opening is coupled to the inlet and may be a triple layer laminated material having a central layer of metallized polyester sandwiched between outer layers of polyethylene film.

The internal layer may be a sheet of triple layer co-extruded polyethylene that is resistant to interaction with the storage material. In a preferred embodiment, the internal layer is four sheets of triple layer co-extruded polyethylene. Each sheet of the internal layer may have a thickness ranging between about 80 and about 150 microns. A preferred thickness for each sheet is 115 microns.

The external and intermediate layers are preferably non-woven geotextile layers. More preferably, the intermediate geotextile layer is a fabric of fine polypropylene multidirectional fibers that are bound with each other, and the external layer is high density polyethylene.

In one embodiment, the internal, internal, intermediate, and external layer bags are coupled to one another only at the inlet. In a more preferred embodiment, the inlet includes two inlets and the internal, intermediate, and external layer bags each have two openings. The two inlets are spaced apart from one another and coupled to the respective openings in the internal, intermediate, and external layer bags. The location of the inlets may vary. They may be positioned on top of the container, as depicted in the figures, or positioned on the ends, such as in the front, bottom, right side corner of the container.

The inlet includes an opening to the interior space with a mounting portion for mounting a valve in the mounting portion and a flange portion configured opposite the mounting portion on the inlet. The flange portion is for coupling with the internal, external, and intermediate layer bags. The opening defines an longitudinal axis in the inlet and the flange portion is preferably perpendicular to the longitudinal axis of the opening.

A valve may be positioned in the mounting portion of the inlet, and a valve protecting collar may be coupled to the valve. The collar is configured to maintain the valve perpendicular to a face of the storage bag.

The storage bag may also include a weld extending through the internal layer, the metallized layer, and the flange portion to couple the respective bags to the flange portion.

In another embodiment, the internal layer is a sheet material with edges. The edges are joined together by a plurality of welds to form the internal layer bag. The metallized layer is a sheet material with edges, and the edges are joined together by a plurality of welds to form the metallized layer bag. The internal layer may include four sheets of material, with each sheet having edges. The edges of the four sheets of material are connected by a weld to define a single bag shape having four layers.

The intermediate layer is preferably a sheet material with edges. The edges are joined together by an adhesive to form the intermediate layer bag. The external layer is also preferably a sheet material with edges. The edges of the external layer sheet material are joined together by an adhesive to form the external layer bag. The adhesive may be a double-sided contact tape.

In the vicinity of the inlet, the intermediate layer may be coupled to the external layer on one side and to the metallized layer on the other side by an adhesive. A weld may connect the internal and metallized layers in the vicinity of, but spaced from, the flange portion of the inlet. A partial external layer may be coupled to the external layer by an adhesive. In addition, a first partial intermediate layer may be coupled to the external layer and the intermediate layer by an adhesive, and a second partial intermediate layer may be coupled to the intermediate layer and metallized layer by an adhesive.

In a preferred embodiment, the intermediate layer bag and external layer bag are dimensionally smaller than the internal layer bag. In another embodiment, the intermediate layer bag and external layer bag are dimensionally smaller than the internal layer bag and the metallized layer bag. In yet another embodiment, the metallized layer bag is dimensionally larger than the internal layer bag.

The storage bag is preferably disposable.

The claimed invention also relates to a system for storing and transporting liquids including a storage bag and a storage container. The storage container is an intermodal container having a footprint, and the storage bag has dimensions similar to the footprint of the intermodal container.

BRIEF DESCRIPTION OF THE DRAWING FIGURES

DETAILED DESCRIPTION

Figure 1:
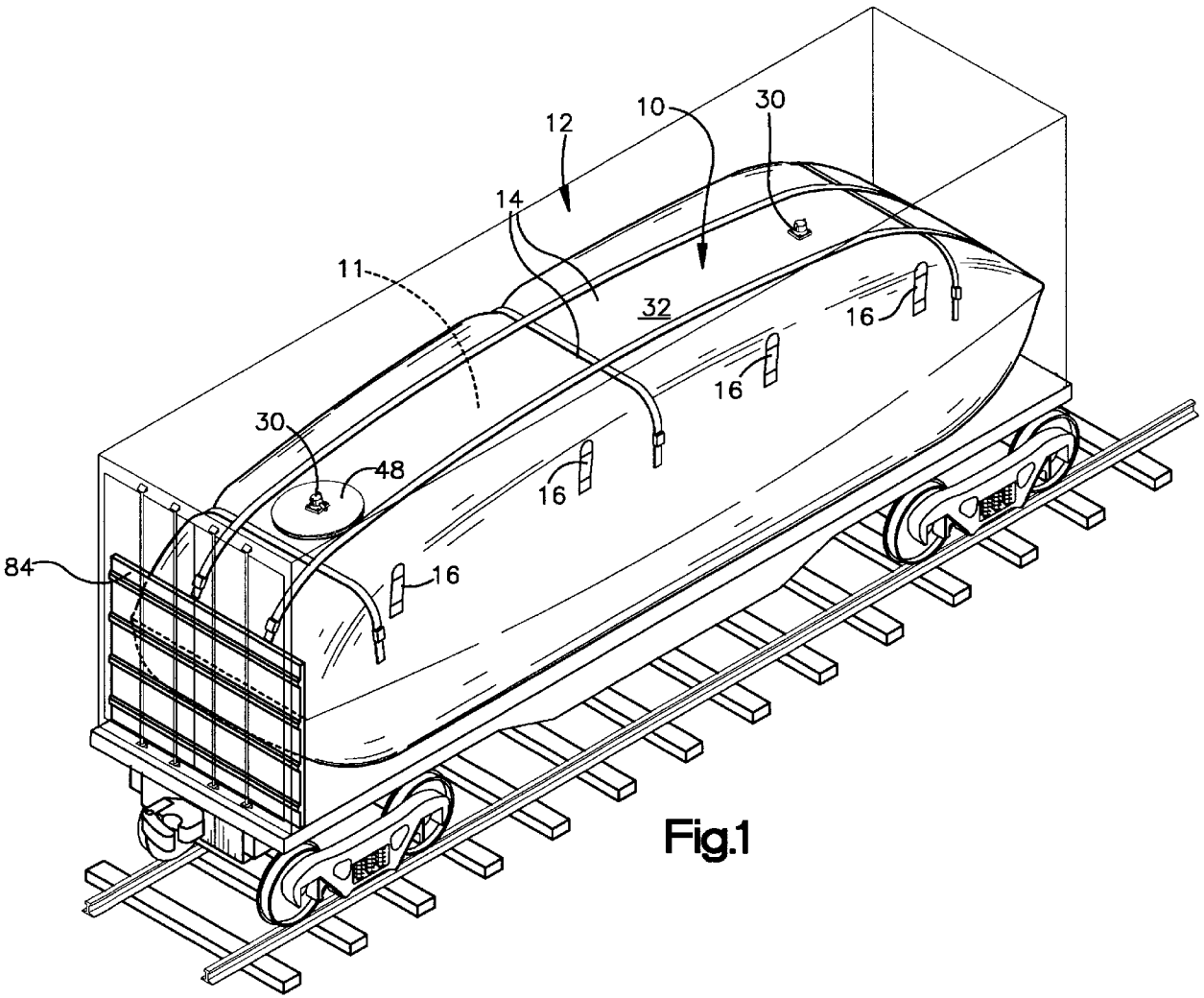
FIG. 1 is a front perspective view of a storage bag of the claimed invention, installed in a bulk intermodal container for shipping purposes.
Figure 9:
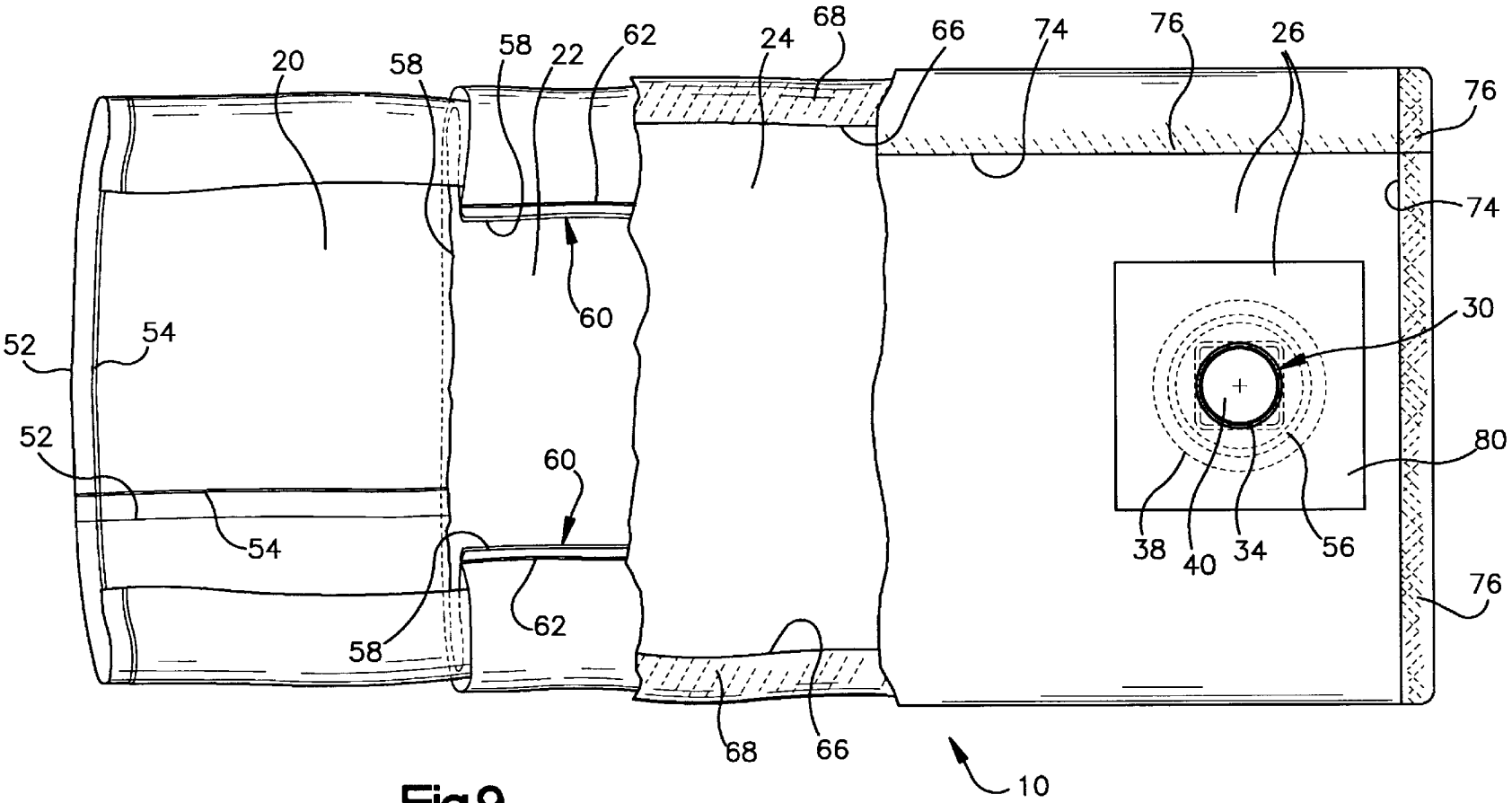
FIG. 9 is a cutaway view of one embodiment of the storage bag in the form of a sack, showing the various layers of the bag and how the layers are situated inside one another.

A storage bag 10 according to one embodiment of the claimed invention is shown in FIG. 1 installed in a shipping container 12, such as an intermodal container. The storage bag 10 is utilized to transport and/or store liquids, and may vary in size based upon the particular application. The bag 10 may be installed in a shipping container 12, such as those that fit on railroad cars, on trucks, or in the holds of ships. Smaller containers 10, as shown in FIG. 9, may be used to store bulk items, such that numerous containers may be shipped at one time and then distributed as needed. The storage bag 10 may be secured in the container 12 by straps 14 to deter movement of the bag 10 due to surging or sloshing of the material inside the bag during shipping. The straps 14 may be independent of the bag 10, as shown in FIG. 1, and attached to the shipping container 12. Alternatively, the storage bag 10 may include attachment points 16 for attaching straps directly to the bag. These straps are connected to the bag at one end and to the container on the other end. Straps are optional and are not required.

The storage bag 10 preferably exhibits at least several of the following physical, mechanical, and chemical characteristics. The bag is preferably disposable. Its walls are made of several layers of diverse materials that provide the desired qualities for effective operation, but at a reduced cost. In particular, the bag is resistant to traction, abrasion, shear and other stresses. It is capable of withstanding internal pressure and external friction against the container 12. Its construction helps to avoid perforations that are typically caused by involuntary or voluntary actions, such as the necessary handling for filling or emptying the bag, or the need to walk over the bag in a filled or empty condition. The bag is preferably imperviousness to the passing of liquids and gases; flexible for ease of folding when empty; and can block the passage of light. In addition, the bag does not react with the product stored in the bag.

Figure 2:
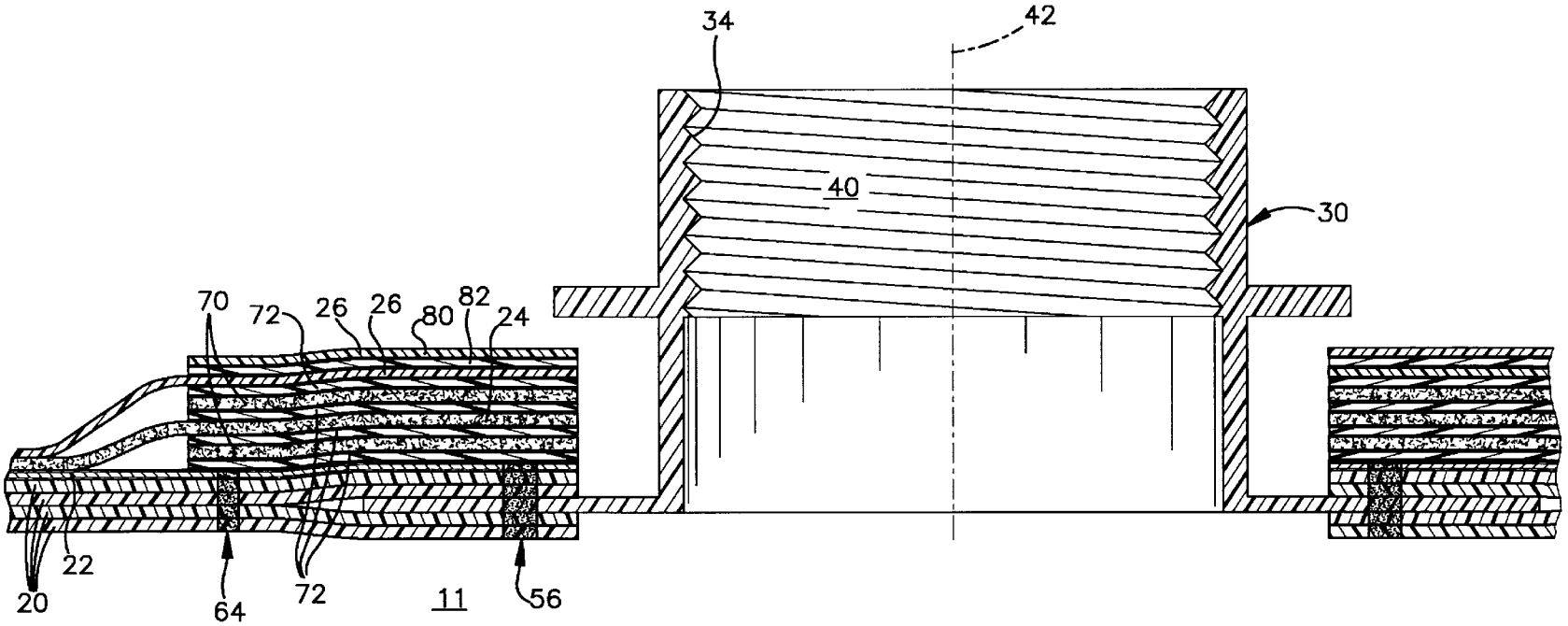
FIG. 2 is a partial cross-sectional view of one embodiment of the storage bag of FIG. 1, showing the inlet with the layers of the bag attached to the inlet.
Figure 3:
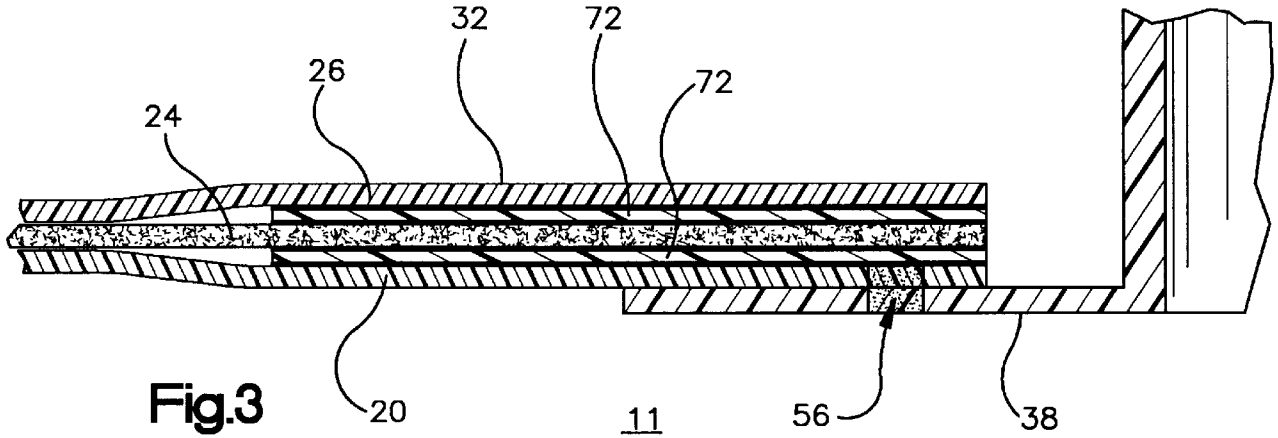
FIG. 3 is a partial cross-sectional view of another embodiment of the storage bag of FIG. 1, showing the inlet with the layers of the bag attached to the inlet.
Figure 4:
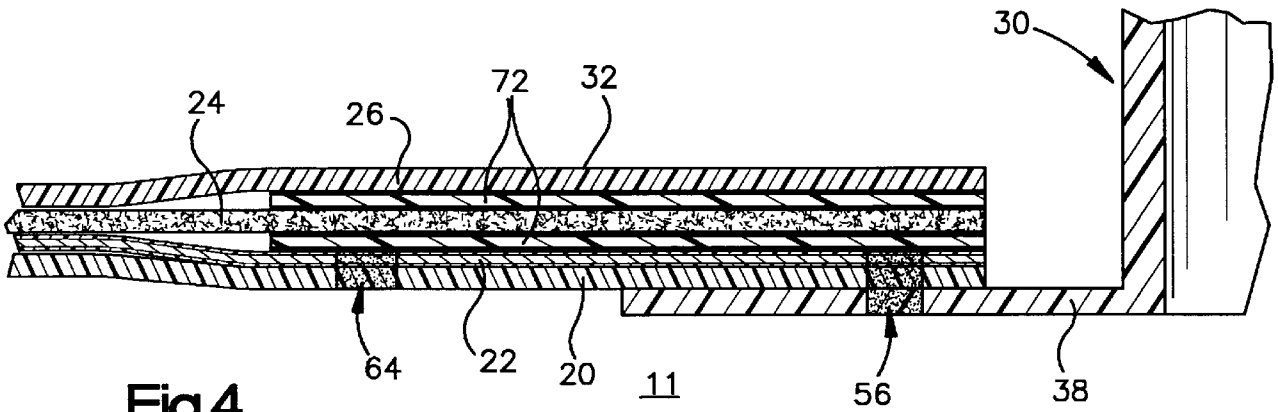
FIG. 4 is a partial cross-sectional view of yet another embodiment of the storage bag of FIG. 1, showing the inlet with the layers of the bag attached to the inlet.

Referring to FIGS. 2–4, the bag has three or four different types of layers, depending upon the particular application. These layers include an internal layer 20, a metallized layer 22, an intermediate layer 24, and an external layer 26. The layers help to provide the bag with tear resistance and to prevent the passage of gas into or out of the internal layer 20. Because the layers are diverse, they allow for optimum recycling of materials.

The storage bag 10 also includes a plurality of inlets 30. A preferred embodiment, as shown in FIG. 1, includes two such inlets on the upper face 32 of the bag 10. The inlets may be positioned at other locations on the bag 10, such as on the front or rear face of the bag 10, in the vicinity of where the doors of a shipping container 12 would be positioned, or in the bottom corner of the bag 10, the invention not being limited to a position on the upper face 32 of the bag 10, as shown in FIG. 1.

Referring to FIGS. 2–4, the inlet 30 is defined independently of the bag layers and may be formed of plastic, or other materials. The inlet 30 includes a mounting portion 34 for coupling to a valve 36, and a flange portion 38 with an opening 40 extending therethrough. The opening preferably is disposed longitudinally through the inlet 30 along a longitudinal axis 42. And the flange portion 38 is preferably positioned perpendicular to the longitudinal axis 42 of the opening 40. As shown in FIGS. 2–4, the flange portion 38 is positioned so that it aligns with the face 32 of the storage bag 10. The flange portion 38 is the portion of the inlet 30 that mates with the storage bag 10.

Figure 6:
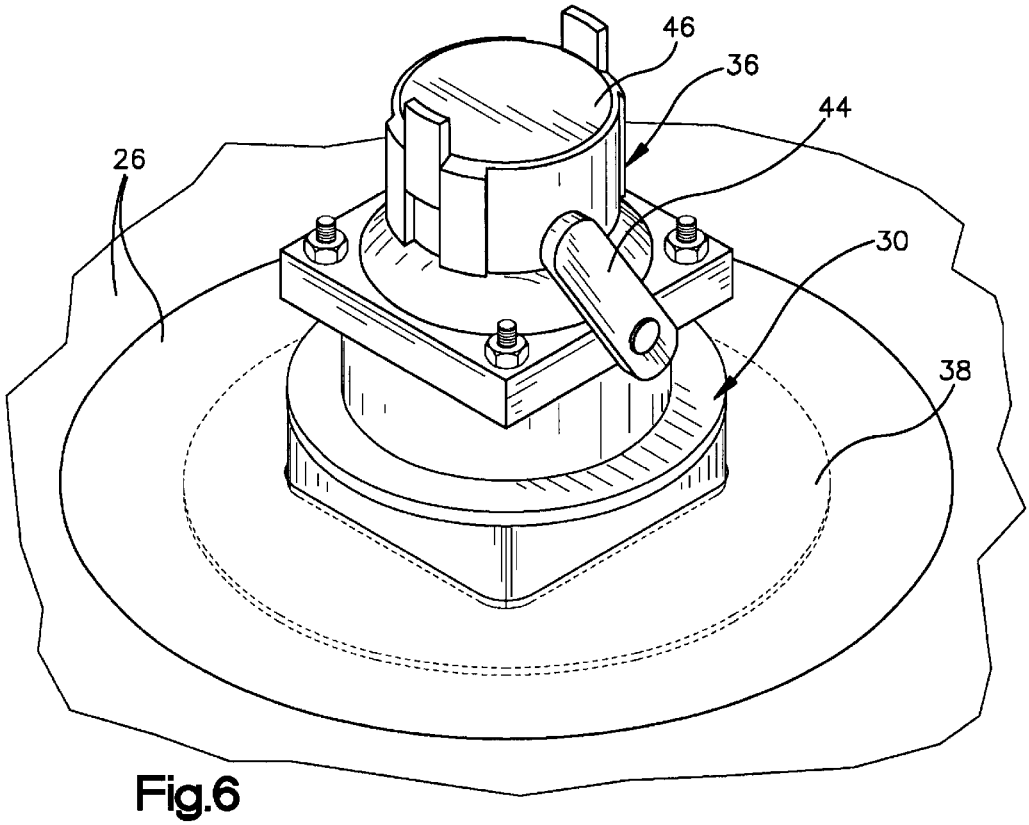
FIG. 6 is a partial top perspective view similar to that of FIG. 5, but showing a valve mounted on the inlet.
Figure 7:
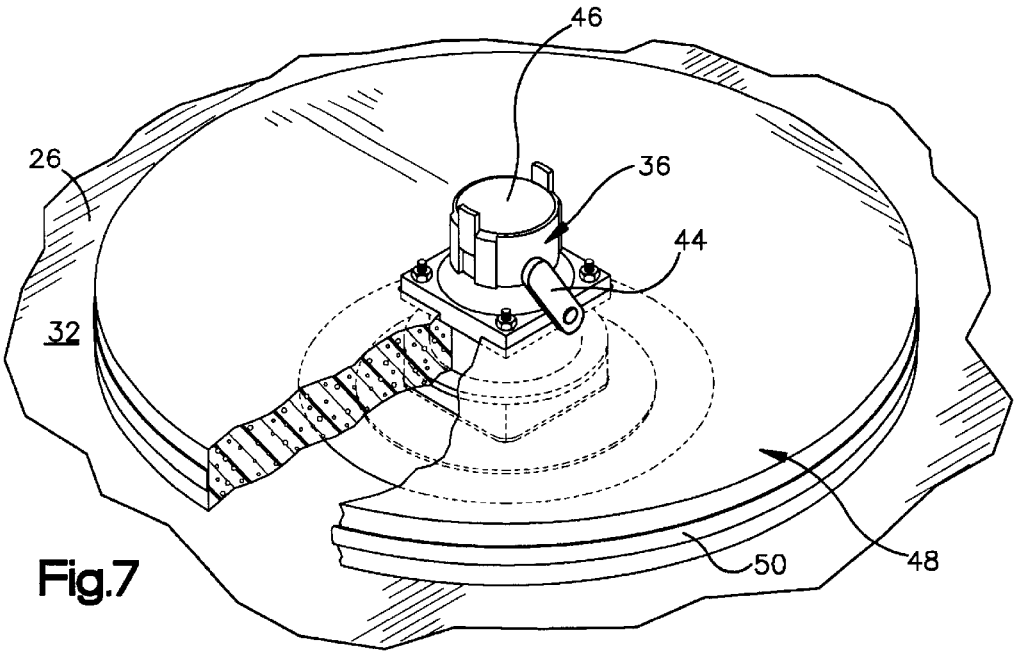
FIG. 7 is a partial top perspective view similar to that of FIG. 6, but showing a valve protecting device positioned around the valve.
Figure 8:
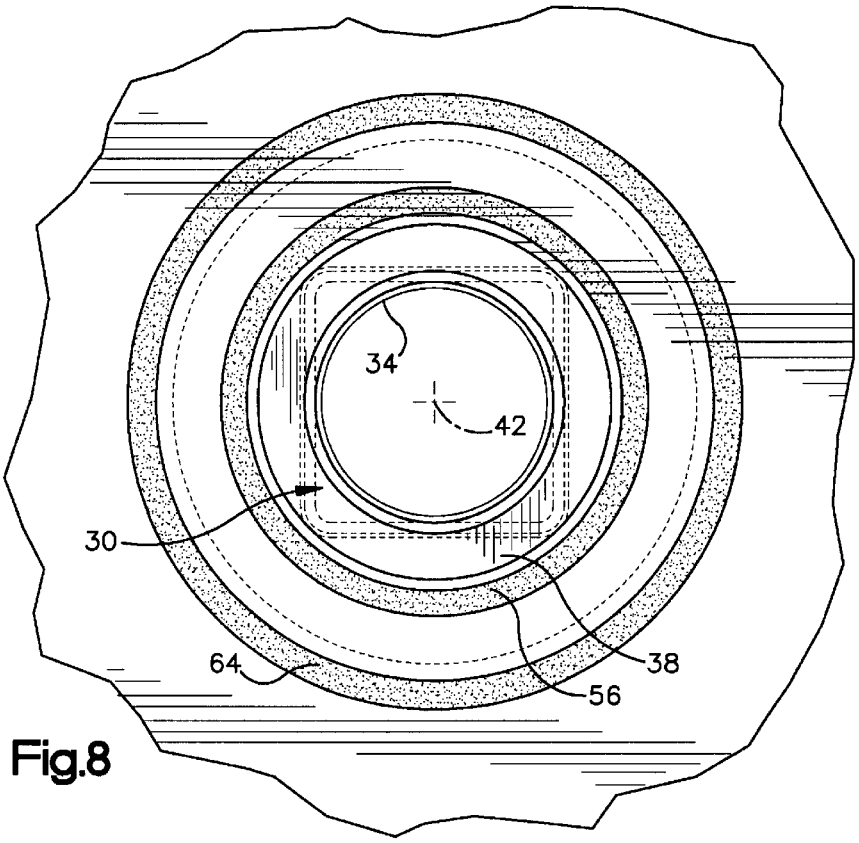
FIG. 8 is a bottom view of the inlet of the storage bag of FIG. 5, when viewed from inside the storage bag.

A valve 36 may be installed in the mounting portion 34 of the inlet 30, as shown in FIGS. 6 and 7. The valve 36 may be any type of valve known by those of skill in the art and preferably includes a mechanism 44 for opening and closing the valve 36. The mounting portion 34 of the inlet 30 preferably includes threads, and the valve 36 may be installed in the mounting portion 34 by screwing in complementary threads on the valve 36. The valve 36 preferably includes a cover 46 for covering the opening to the valve 36. The cover 46 is removable and configured to allow joining with a filling hose nozzle (not shown). When desired to fill the bag 10, the cover 46 is removed and the hose is hooked up to the valve opening. The valve lever 44 is turned to open the valve 36 and the hose then passes a storage material into the bag 10. When the bag 10 is filled, the valve 36 is closed, the filling hose is removed, and the cover 46 is replaced on the valve 36.

Referring to FIG. 7, a protective collar 48 may be positioned around the valve 36 during transport. The protective collar 48 is utilized to maintain the valve 36 in a substantially perpendicular orientation relative to the face 32 of the bag 10 during transport, and helps to reduce any mechanical stresses that may be applied to the bag 10 caused by the weight of the valve 36 against the inlet 30 and bag structure. The collar 48 may be made of high-density expanded polystyrene. A retaining material 50, such as tape, may be applied around the periphery of the collar to add strength and stability to the collar 48. The protective collar 48 may be positioned around the valve 36 regardless of the valve's location on the bag 10.

Referring again to FIGS. 2–4 and 10, the internal layer of the bag 10 defines an interior space 11 that is utilized to hold a stored material. The internal layer 20 will come into direct contact with the material being stored. Therefore, it is important that the internal layer not react with the stored material, or that the stored material not react with the internal layer 20. In a preferred embodiment, shown in FIG. 2, the internal layer 20 includes several identical polyethylene layers, each of which is a triple layer co-extruded sheet. The desired thickness of the sheets may vary, but one preferred range of thickness is between about 80 and 150 microns each. A more preferred thickness is 115 microns.

Figure 10:
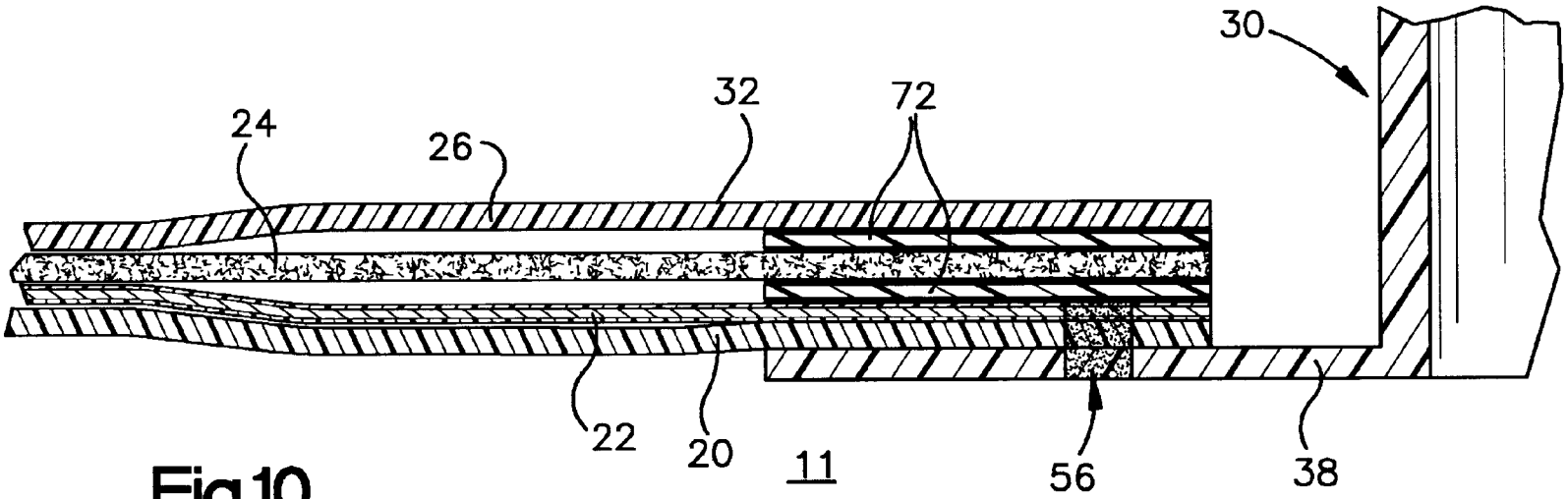
FIG. 10 is a partial cross-sectional view of yet another embodiment of the storage bag of FIG. 1, showing the inlet with the layers of the bag being attached only at the inlet.

In one embodiment, four sheets of polyethylene are used for the internal layer 20, as shown in FIG. 2. When four sheets are used, two of the sheets may be positioned under the flange portion 38 and two of the sheets may be positioned over the flange portion 38, as shown. Alternatively, the sheets may all be positioned over the flange portion 38 or in other configurations. In an alternative embodiment, a single layer of polyethylene is utilized for the internal layer 20, as shown in FIGS. 3, 4, and 10. Polyethylene is a desirable material because it is inert, and therefore useful in transporting all types of liquids, such as wine, fruit juice or concentrate, vegetable and mineral oils, and many other types of liquids. An inner layer of polyethylene offers traction resistance and is capable of some elongation. Other similarly inert materials may also be utilized. FIG. 10 depicts an embodiment where the layers 20, 22, 24, 32 are coupled to one another only at the inlet 38.

The internal layer sheets have free edges 52 which are joined together to form a bag shape, as shown in FIG. 9. A preferred joining technique is welding, such as thermofusion welding. Where a single sheet of material is utilized in the internal layer 20, a weld line 54 may be positioned along the top and bottom edges of the bag, as well as along a side seam. Where four sheets of internal layer material are utilized, the four sheets may be welded together along a single weld line 54 along the top and bottom edges of the bag, as well as along a side seam to form a single bag. The inner most sheet of the internal layer is in contact with the stored material, and the remaining layers are provided to contain the stored material in the event of any leaks from the inner-most layer, and also to provide additional strength to the bag. Alternatively, the edges 52 may be individually joined to each other for each sheet. For instance, when four sheets are utilized, each sheet may be welded to form its own individual bag, resulting in four bags, with independent weld lines 54 positioned around the top and bottom edges 52, as well as a side seam for each bag. Either technique helps to promote the integrity of the internal layers by protecting the other layers should a single layer of the group fail. Furthermore, while a particular construction of the bag is shown and described as having bottom, top, and side seams, the location of the seams may vary.

When the sheets of the internal layer are not large enough to cover the entire necessary dimensions of the bag 10, multiple sheets may be joined together along their edges utilizing a joining technique, such as thermofusion welding. As a result, weld lines may be formed at a variety of locations on the bag 10. Other types of joining techniques may also be utilized, as known by those of skill in the art.

A joining technique is also utilized to join the internal layer 20 to the loading inlet 30. A preferred system is welding, as described above, although other joining techniques as known by those of skill in the art may also be utilized. As shown in FIG. 1, a plurality of inlets 30 may be provided on each bag 10, although bags 10 with single inlets 30 are also contemplated. Referring to FIGS. 2–5, as previously discussed, a preferred inlet includes an annular lip or flange portion 38, which is oriented to lie in the plane of the internal layer 20. The internal layer 20 is preferably joined to the flange portion 38 by a technique such as thermofusion welding, which produces a weld line 56 through the weld area, as shown in FIGS. 2–6 and 8–9. A number of welds may be formed on or near the inlet 30 in order to secure the internal layers 20 and metallized layer 22 to the inlet and each other, as discussed in greater detail below.

The second type of layer is the metallized layer 22. The metallized layer 22 is preferably positioned over the internal layer 20. The metallized layer 22 is preferably light-blocking and is formed in the shape of a bag, similar to that of the internal layer 20. In addition to preventing the passage of light, the metallized layer 22 helps to ensure the imperviousness of the bag against the passage of gases. Its effectiveness is about 96% guaranteed against the passage of light and about 99.8% guaranteed against the passage of gases. Because a light and gas blocking layer is not always needed for each application, the metallized layer 22 is optional. For example, a light-blocking layer is not required for the storage and transportation of lubricant oil, detergents, synthetic latex or polymer emulsions, among other things.

In a preferred embodiment, the metallized layer 22 is a triple layer film made of external polyethylene layers and an internal central layer of metallized polyester. The metallized layer 22 is formed as a bag independently from the internal layer 20. It is preferably sized slightly larger dimensionally in all dimensions than the internal layer 20 bag. The metallized layer 22 is formed from a sheet of metallized material having a plurality of edges 58. The edges 58 of the sheet are joined to one another to form a bag shape. As shown in FIG. 9, the metallized sheet may be folded into a bag shape to define a top joined edge, a bottom joined edge, and a side joined edge 60. The edges 58 may be joined by any joining technique, such as by thermofusion welding. When welded, a weld line 62 is positioned along the top, bottom, and side edges where the sheet is joined to itself.

The metallized layer 22 is preferably joined to the inlet 30 along with the internal layer 20. In one embodiment, the metallized layer 22 is welded to the inlet flange portion 38, along with the internal layer 20, to form a weld line 56 through the internal layer 20, the inlet flange portion 38, and the metallized layer 22. The metallized layer 22 may also be welded to the internal layer 20 at a point spaced from the inlet flange portion 38, as shown in FIGS. 2–4 and 8, to form another weld line 64. This adds to the strength and integrity of the bag 10. It is preferred that, when a metallized layer 22 is utilized, it will be welded to both the inlet flange portion 38 and the internal layer 20. Since the external layers of the metallized layer 22 are made of polyethylene, the metallized layer 22 is easily welded to the internal layer 20 and flange portion 38.

The third type of layer is a resistant intermediate layer 24. This layer is positioned over both the metallized layer 22 and the internal layer 20. The intermediate layer 24 is preferably a geotextile that is a multidirectional non-woven polypropylene fabric made of very fine fibers. The fibers are adhered together by heat and pressure during the manufacturing process. The fibers exclude binders and fillers, and, as a result, have strong mechanical properties. DuPont offers commercial fabrics of this type under the trade names "Xavan", "Rocap", and "Typar."

The intermediate layer 24 is a bag formed independently from the internal and metallized layer bags. Its size is smaller dimensionally in all dimensions than the metallized layer 22 and internal layer 20, in order to receive the mechanical stresses originating in these layers. The intermediate layer 24 is joined to the internal 20 and metallized 22 layers only along the annular flange portion 38 of the inlet 30. In a preferred embodiment, as shown in FIGS. 2–4 and 8–9, the intermediate layer 24 is joined to the flange portion 38 with an adhesive, such as a double sided tape, although the intermediate layer 24 may alternatively be welded to the flange portion 38 along with the metallized layer 22 and internal layer 20 (not shown).

The intermediate layer 24 is a sheet having edges 66. The sheet is formed as a bag shape by applying adhesive 68 to bind the fabric along its edges 66. For instance, overlapping edges may be provided along the top, bottom, and/or sides, as shown in FIG. 9. An adhesive 68 is applied to the overlapping edges 66, and the bag is formed by binding the overlapping edges with the adhesive 68. In addition, adhesive 68 may be used to apply multiple layers of the intermediate layer fabric around the inlet. As shown in FIG. 4, two additional partial intermediate layers 70 may be positioned around the inlet flange portion 38. These partial layers 70 preferably are larger dimensionally than the flange portion 38. They may be round, square, or other shapes. The additional partial layers 70 are utilized to strengthen the bag 10 around the inlet 30. As shown in FIG. 4, layers of adhesive 72 are positioned between the partial intermediate layers, intermediate layer 24, the metallized layer 22, and the external layer 26. The additional partial intermediate layers 70 are joined along with the intermediate layer 24 to the inlet flange portion 38 by an adhesive, such as a double-sided contact tape. One type of adhesive that may be utilized is 3M brand double contact tape.

Internal pressure strength tests have been performed on a bag 10 having an intermediate layer as described above. This bag was found to have a capacity to resist a pressure of over 6 bar without consequence to the bag. This figure greatly exceeds the 1 bar pressure resisted by bags currently offered on the commercial market.

The fourth layer is the external layer 26. The external layer 26 is a non-woven fiber material, such as high-density polyethylene. The external layer 26 is formed in the shape of a bag and is independent from the other layer bags. In a preferred embodiment, the external layer 26 bag is about the same size as the intermediate layer 24 bag. The bag shape of the external layer 26 is formed in a manner similar to that of the intermediate layer bag 24. The external layer 26 is formed as a bag shape by applying adhesive 76 to bind the sheet along its edges 74. Overlapping edges 74 of the external layer 26 may be provided along the top, bottom, and/or sides. An adhesive 76 is applied to the overlapping edges 74, and the bag is formed by binding the overlapping edges 74 with the adhesive 76.

Figure 5:
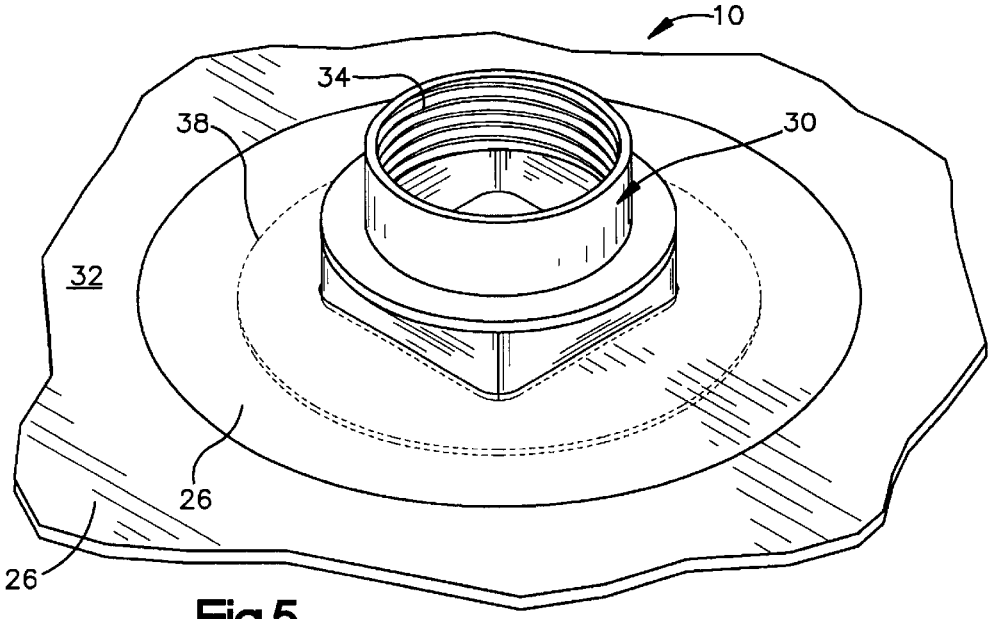
FIG. 5 is a partial top perspective view of the storage bag showing an inlet coupled to the storage bag.

In addition, adhesive 76 may be used to apply multiple layers of the external layer 26 around the inlet 30. For example, as shown in FIGS. 2, 5 and 9, an additional partial external layer 80 may be positioned over external layer 26 around the inlet flange portion 38. The additional partial external layer 80 may be any desired shape, such as round (shown in FIG. 5) or rectangular (shown in FIG. 9). The partial external layer 80 is preferably larger dimensionally than the inlet flange portion 38. The additional partial external layer 80 preferably is used to add stability and strength to the bag 10 in the vicinity of the inlet 30. The partial external layer 80 is attached to the external layer 26 by an adhesive layer 82. One type of adhesive layer 82 that may be utilized is 3M brand double contact tape.

In addition, the external layer 26 and partial external layer 80 are bound to the other layers only in the vicinity of the inlet flange portion 38. The preferred attachment technique is adhering the internal layers 26, 80 to the remaining layers and the annular inlet flange using an adhesive, as shown in FIGS. 2–4 and 8–9. In addition, a weld (not shown) may be positioned through all the layers on the flange portion 38.

The external layer 26 is highly resistant to friction and deters rubbing of the bag against the container 12, which could otherwise destroy the bag 10. In addition, the external layer 26 preferably slides or acts in a lubricating manner such that the external layer 26 does not bind against the container 10 or the remaining layers 20, 22, 24 of the bag 10. The external layer 26 also preferably allows for the presentation of an image on its surface. It preferably is impervious and provides good printing quality. In addition, the external layer 26 may be water tight. DuPont offers this type of fabric to the commercial market under the trade name "Tyvek".

Referring to FIG. 9, a smaller version of the bag 10 is shown in the form of a sack having a single inlet 30. The sack, however, is exemplary of larger bags, except that larger bags will usually have multiple inlets 30. The bag is shown as including internal layer 20, metallized layer 22, intermediate resistant layer 24, and external layer 26. As shown, metallized layer 22 is slightly larger in all dimensions than internal layer 20. Intermediate layer 24 is smaller in all dimensions than both the metallized layer 22 and the internal layer 20, as shown by the folded over portions of the metallized and internal layers 22, 20 in FIG. 9. Intermediate layer 24 is smaller than the inner layers in order to receive the mechanical stresses that originate in the inner layers. Lastly, the external layer 26 is preferably about the same size as the intermediate layer 24.

In use, the bag 10 is first placed inside a container, such as that shown in FIG. 1, and a loading or discharge hose or line (not shown) is connected to the inlet 30. A barrier 84 may be positioned at the end of the container, near the door of the container. This barrier 84 may be made of expanded polystyrene, wood, or other materials. Loading or discharge of the bag 10 may be conducted using a pump when the valve is positioned on the top face of the bag, or by gravity when the valve is placed on the bottom comer of the front face of the bag. The bag 10 may be filled with any type of liquid cargo. During filling, gases, such as nitrogen carbonic acid, may be flushed inside the bag 10 so that gas escapes through the other inlet during filling. Once the bag is filled, the valve inlet 46 is closed and the filling hose removed. The gas discharge inlet is also closed, and the valve inlet protection collar 48 is then installed around the valve 36. The door to the container 12 may then be closed for transport.

The bag may be manufactured in several sizes and designs for differing intended uses. Exemplary sizes include 16,000, 18,000, 20,000, 21,000, 22,000, 24,000, and 26,000 liters. The bag may vary in size from small to very large. Small bags may be utilized for the retail sale of products, such as bags weighing approximately 2 kg. Larger size bags, such as 50 kg bags, may be carried by hand, similar to a traditional sack (as shown in FIG. 9). Even larger bags, such as 1 cubic meter bags, may be carried by mechanized transportation, such as fork lifts. Very large bags may be stored and/or transported inside conventional intermodal containers on board of vessels, aircraft, trucks, rails and other vehicles. With respect to the latter, once the storage bag 10 is placed inside the container 12, it may be easily filled without a serious risk of spilling the contents to the environment or inside the container, and without contaminating the product carried in the bag 10. The bag 10 may be sealed prior to closing the shipping container 12 and may be emptied easily in a hygienic manner. Alternatively, these very large bags may be transported without placing them in a shipping container. They may be placed on a flat-bed truck with racks for minor transportation. In addition, the storage bag 10 may be used for standalone storage. Finally, it should be pointed out, that, in addition to liquids, many dusts, crystals, pellets and grains can be handled using the storage bag, to the extent they can easily flow.

The cost of manufacturing the storage bag is lower than previously designed bags, thus permitting it to be disposable. Since the different types of layers of the bag 10 are separate from each other, other than where they are welded or glued together around the inlet 30, they may be easily separated for recycling purposes. This allows a further reduction in cost and avoids the accumulation of undesirable waste.

While various features of the claimed invention are presented above, it should be understood that the features may be used singly or in any combination thereof. Therefore, the claimed invention is not to be limited to only the specific embodiments depicted herein.

Further, it should be understood that variations and modifications may occur to those skilled in the art to which the claimed invention pertains. The embodiments described herein are exemplary of the claimed invention. The disclosure may enable those skilled in the art to make and use embodiments having alternative elements that likewise correspond to the elements of the invention recited in the claims. The intended scope of the invention may thus include other embodiments that do not differ or that insubstantially differ from the literal language of the claims. The scope of the present invention is accordingly defined as set forth in the appended claims.

What is claimed is:

1. A storage bag for carrying a storage material comprising:

an internal layer configured as a separate bag to define an interior space for storing the storage material, said internal layer bag having an opening for entrance of the storage material into the interior space;

an external layer that is perforation resistant, said external layer configured as a separate bag with an opening and positioned around the internal layer bag;

an intermediate layer configured as a separate bag with an opening, said intermediate layer bag positioned between said internal layer and said external layer; and an inlet for loading and discharge of the storage material into and from the interior space, wherein the internal, intermediate and external layer bag openings are coupled to the inlet, wherein the external and intermediate layers are nonwoven geotextile layers, the intermediate geotextile layer is a fabric of fine polypropylene multidirectional fibers that are bound with each other, and the external layer is high density polyethylene.

2. A storage bag for carrying a storage material comprising:

an internal layer configured as a bag to define an interior space for storing the storage material, said internal layer bag having an opening for entrance of the storage material into the interior space;

an external layer that is perforation resistant, said external layer configured as a bag with an opening and positioned around the internal layer bag;

an intermediate layer configured as a bag with an opening, said intermediate layer bag positioned between said internal layer and said external layer;

a metallized layer configured as a bag with an opening and positioned between the internal layer and the intermediate layer; and an inlet for loading and discharge of the storage material into and from the interior space, wherein the internal, metallized, intermediate and external layer bag openings are coupled to the inlet;

wherein the internal layer is a sheet material with edges, and the edges are joined together by a plurality of welds to form the internal layer bag; the metallized layer is a sheet material with edges, and the edges are joined together by a plurality of welds to form the metallized layer bag; the intermediate layer is a sheet material with edges, and the edges are joined together by an adhesive to form the intermediate layer bag; the external layer is a sheet material with edges, and the edges are joined together by an adhesive to form the external layer bag; in the vicinity of the inlet, the intermediate layer is coupled to the external layer on one side and to the metallized layer on the other side by an adhesive; the adhesive is a double-sided contact tape; a weld connects the internal and metallized layers in the vicinity of, but spaced from, the inlet flange portion.

3. A storage bag for carrying a storage material comprising:

an internal layer configured as a bag to define an interior space for storing the storage material, said internal layer bag having an opening for entrance of the storage material into the interior space;

an external layer that is perforation resistant, said external layer configured as a bag with an opening and positioned around the internal layer bag;

an intermediate layer configured as a bag with an opening, said intermediate layer bag positioned between said internal layer and said external layer;

an inlet for loading and discharge of the storage material into and from the interior space, wherein the internal, intermediate and external layer bag openings are coupled to the inlet; and a metallized layer configured as a bag with an opening and positioned between the internal layer and the intermediate layer, said metallized layer opening being coupled to the inlet, wherein the intermediate layer bag and external layer bag are dimensionally smaller than the internal layer bag and metallized layer bag.

4. The storage bag of claim 3, wherein the metallized layer bag is dimensionally larger than the internal layer bag.

* * * * *